US006902067B1

(12) United States Patent
Barnes, Jr.

(10) Patent No.: US 6,902,067 B1
(45) Date of Patent: Jun. 7, 2005

(54) IN-SHELL NUT SORTING AND DEBRIS REMOVAL ASSEMBLY

(76) Inventor: Henry H. Barnes, Jr., 1340 Edmonds Rd., P.O. Box 84, Severn, NC (US) 27877

( * ) Notice: Subject to any disclaimer, the term of this patent is extended or adjusted under 35 U.S.C. 154(b) by 242 days.

(21) Appl. No.: 10/384,421

(22) Filed: Mar. 7, 2003

(51) Int. Cl.[7] ..... B07C 5/04

(52) U.S. Cl. ..... 209/632; 209/138; 209/139.1; 209/145; 209/620; 209/665

(58) Field of Search ..... 209/632, 620, 209/665, 663, 674, 681

(56) References Cited

U.S. PATENT DOCUMENTS

| | | | | | |
|---|---|---|---|---|---|
| 1,079,905 | A | | 11/1913 | Seagrave | |
| 3,475,889 | A | * | 11/1969 | Overstreet et al. | 56/328.1 |
| 4,364,222 | A | * | 12/1982 | Ramacher | 56/328.1 |
| 4,535,894 | A | * | 8/1985 | Shell | 209/665 |
| D285,206 | S | | 8/1986 | Johnson | |
| 4,696,151 | A | | 9/1987 | Hobbs | |
| 4,793,918 | A | | 12/1988 | Thomas | |
| 4,927,030 | A | * | 5/1990 | Chastain et al. | 209/620 |
| 5,033,932 | A | * | 7/1991 | Compton | 414/528 |
| 5,087,351 | A | * | 2/1992 | Valentine, Sr. | 209/20 |
| 5,421,147 | A | * | 6/1995 | Holden et al. | 56/328.1 |
| 5,467,700 | A | * | 11/1995 | Dowell et al. | 99/570 |
| 5,879,734 | A | * | 3/1999 | Broyles | 426/481 |
| 5,967,333 | A | * | 10/1999 | Smith | 209/135 |
| 6,527,124 | B1 | * | 3/2003 | Nakhei-Nejad | 209/173 |

* cited by examiner

*Primary Examiner*—Donald P. Walsh
*Assistant Examiner*—Jonathan R Miller

(57) ABSTRACT

An in-shell nut sorting and debris removal assembly for removing debris including empty shells and sorting out unacceptable in-shell nuts includes multiple spaced belt sorting assemblies to removed materials having desired size characteristics and send them into a collision chamber where the materials are subjected to air current to promote collisions between the materials. An inclined or angled separator screen mesh permits the upward air flow and sorts the materials by density as the collisions occur within the collision chamber. Upper and lower openings are used to remove the density sorted materials from the collision chamber. The lower opening is further divided to sort excessively dense materials such as rock from materials having the desired density characteristics.

17 Claims, 7 Drawing Sheets

IN-SHELL NUT SORTING AND DEBRIS REMOVAL ASSEMBLY

BACKGROUND OF THE INVENTION

1. Field of the Invention

The present invention relates to nut sorting and debris removal devices and more particularly pertains to a new in-shell nut sorting and debris removal assembly for removing debris including empty shells and sorting out unacceptable in-shell nuts.

2. Description of the Prior Art

The use of nut sorting and debris removal devices is known in the prior art. U.S. Pat. No. 5,087,351 describes a device for sorting nuts using a fluidized bed that sorts by weight using air passed through a base screen. Another type of sorting and debris removal device is U.S. Pat. No. 4,793,918 having a perforate separator deck. U.S. Pat. No. 1,079,905 discloses a machine for separating gangue without using water. U.S. Pat. No. 5,467,700 discloses a density separation sheller. U.S. Pat. No. 4,696,151 discloses a machine using parallel shafts all rotating in the same direction and a blower to separate chaff from peanuts. U.S. Patent No. Des. 285,204 an ornamental design for a rack for seed sorting.

While these devices fulfill their respective, particular objectives and requirements, the need remains for a machine that more reliably and accurately sorts in-shell nuts from empty shells and debris.

SUMMARY OF THE INVENTION

The present invention meets the needs presented above by providing multiple spaced belts assemblies for initially sorting objects by size, followed by an inclined mesh separator screen within a chamber in which collisions between objects are initiated to sort the objects based on relative density.

An object of the present invention is to provide a new in-shell nut sorting and debris removal assembly that removes empty shells from nuts in the shell.

To this end, the present invention generally comprises a multi-phase machine for sorting debris and unwanted materials from in-shell nuts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
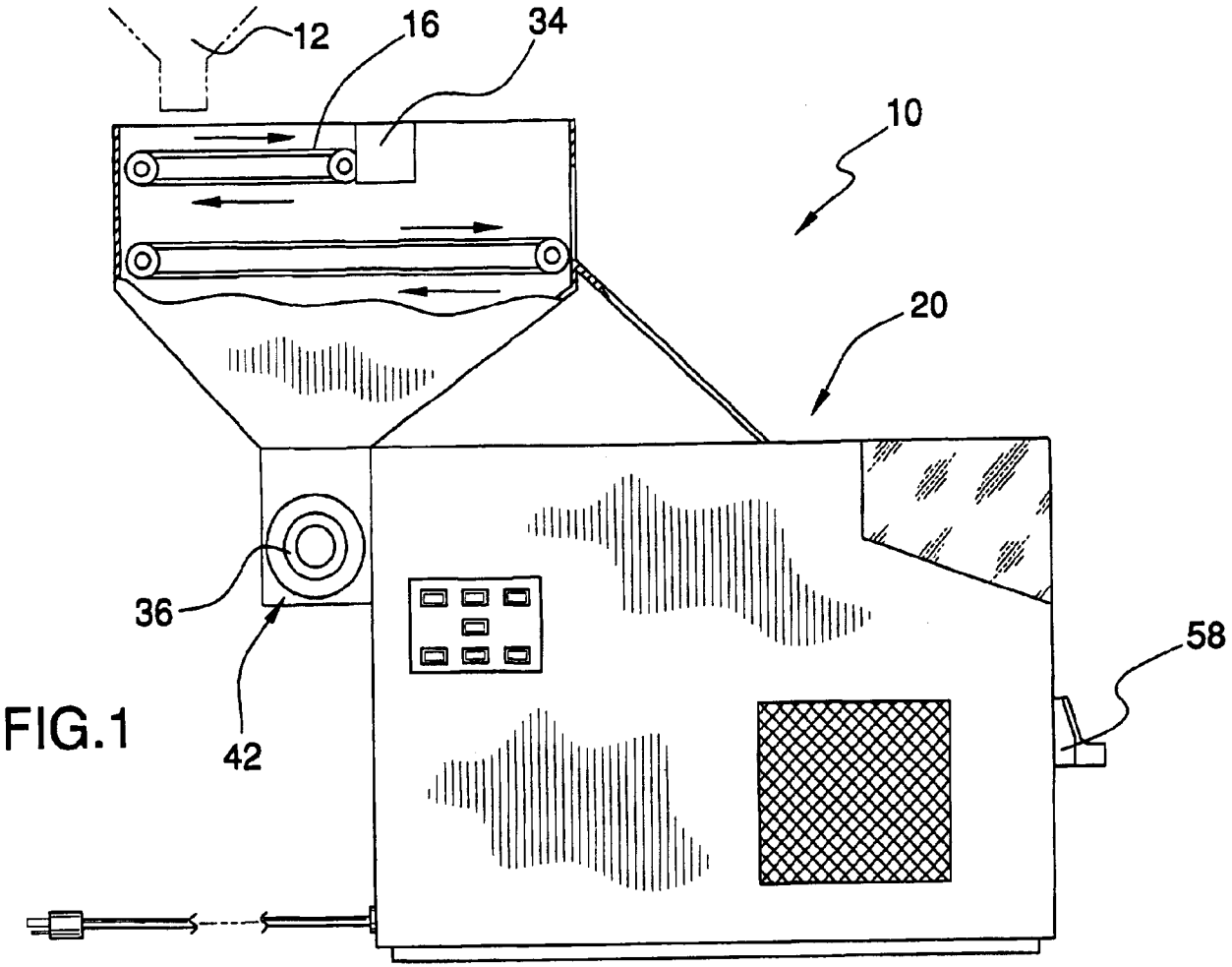
FIG. 1 is a side view of a new in-shell nut sorting and debris removal assembly according to the present invention.
Figure 2:
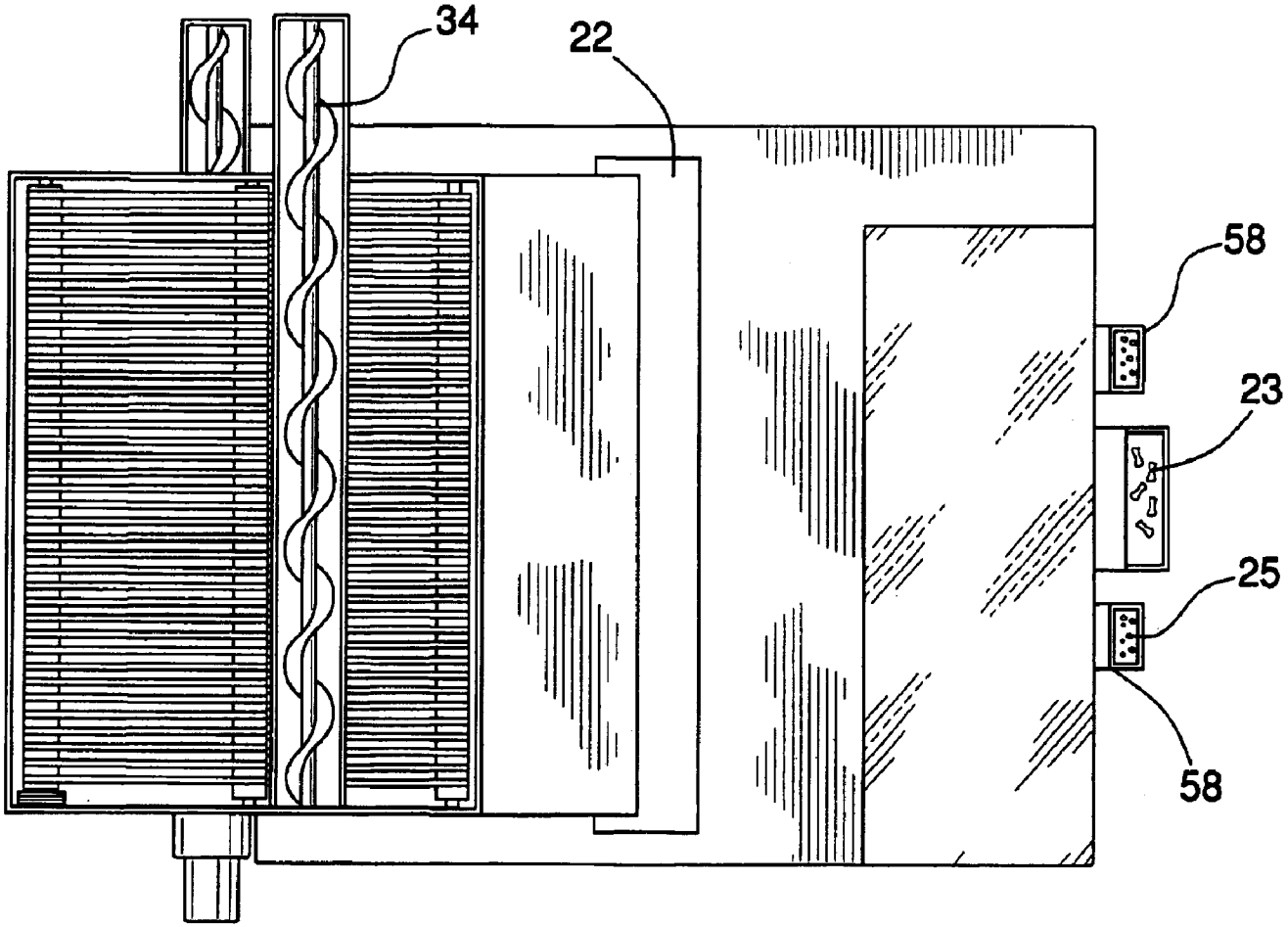
FIG. 2 is a top view of the present invention.
Figure 3:
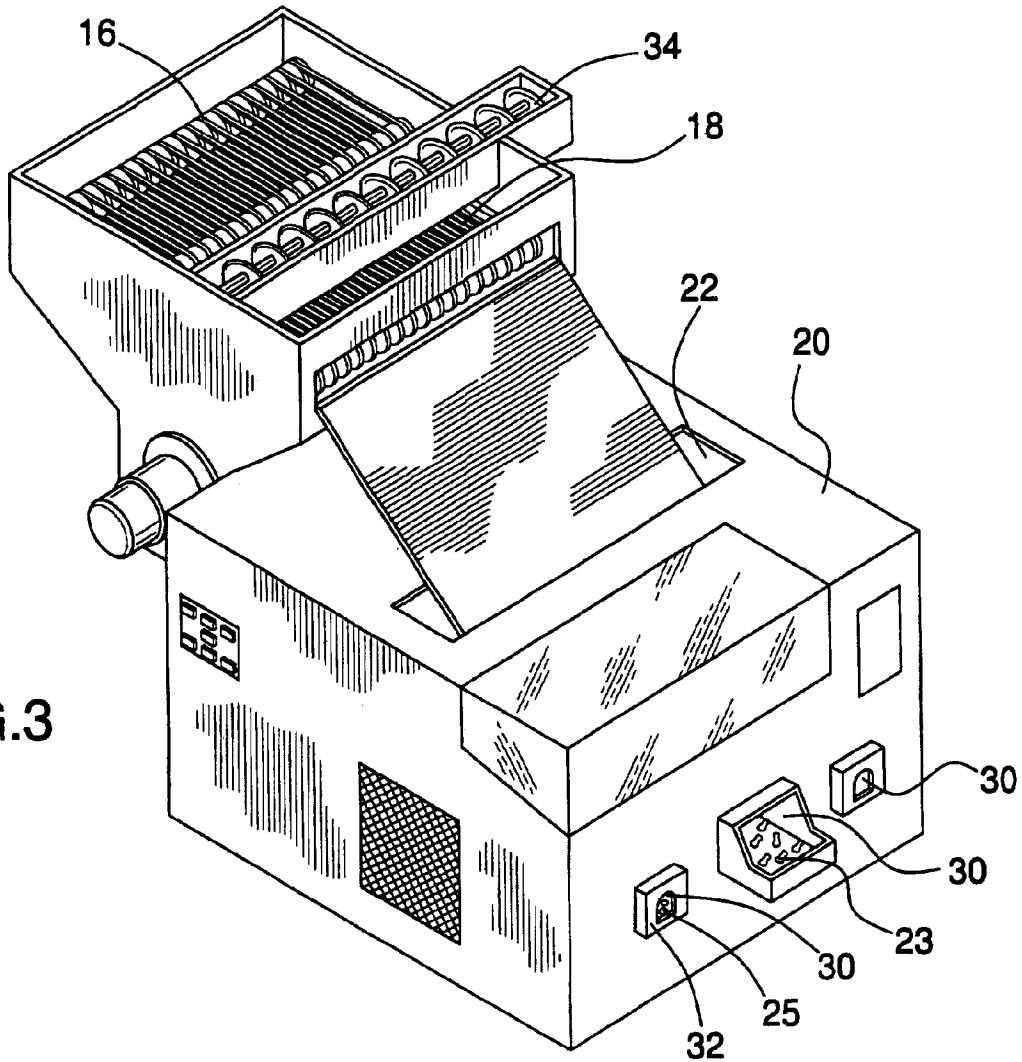
FIG. 3 is a perspective view of the present invention.
Figure 4:
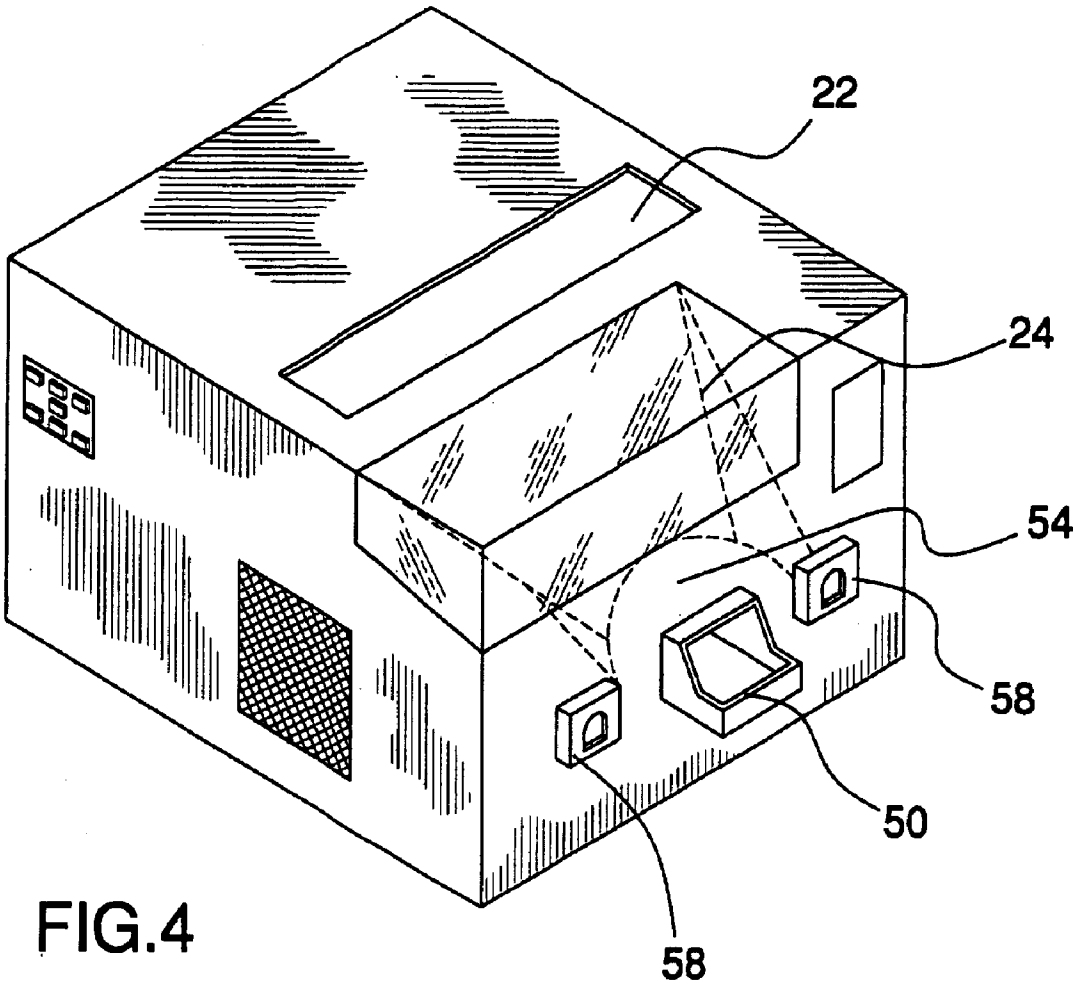
FIG. 4 is a perspective view of the collision chamber of the present invention.
Figure 5:
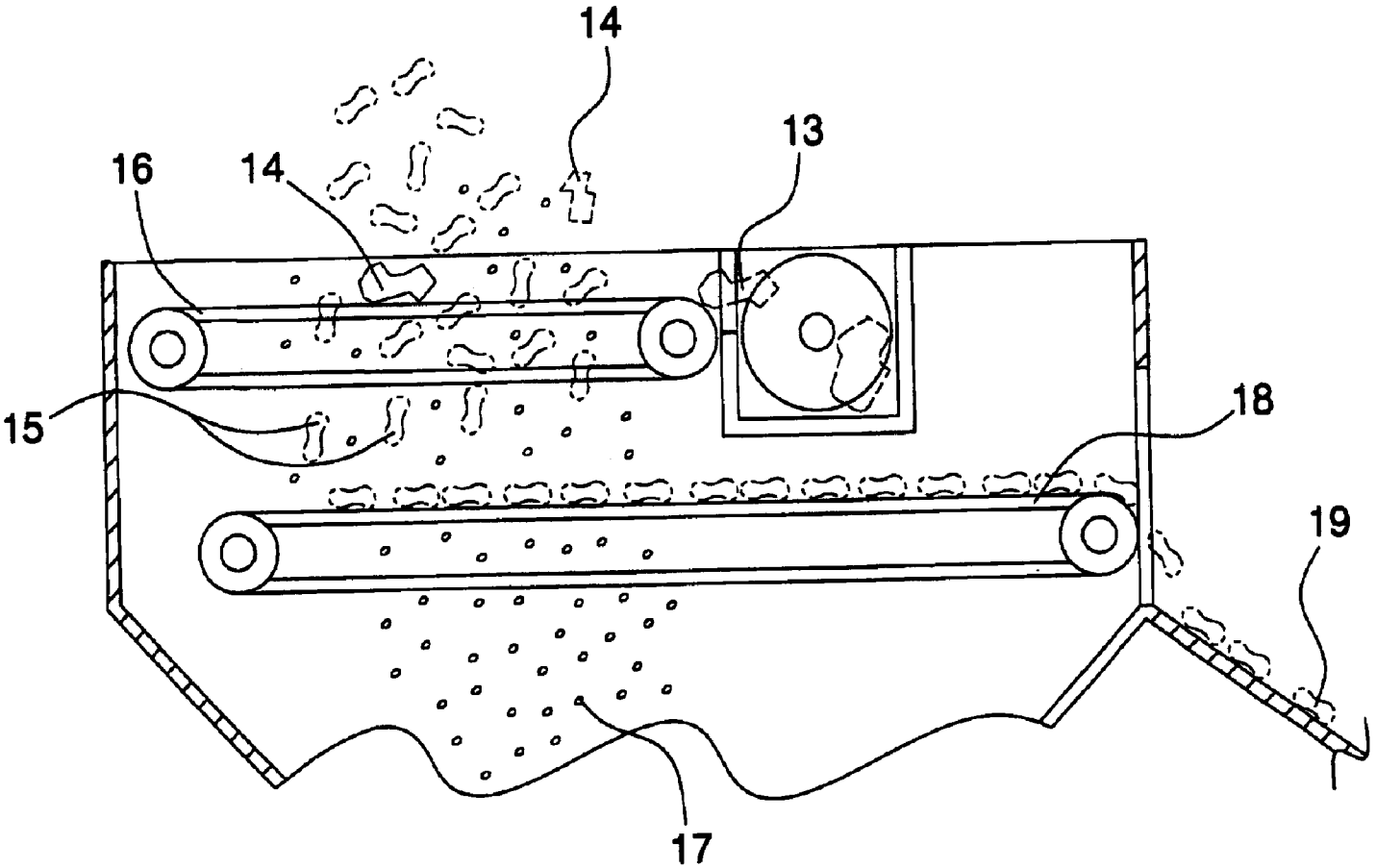
FIG. 5 is a cross-sectional view of an initial sorting assembly of the present invention.
Figure 6:
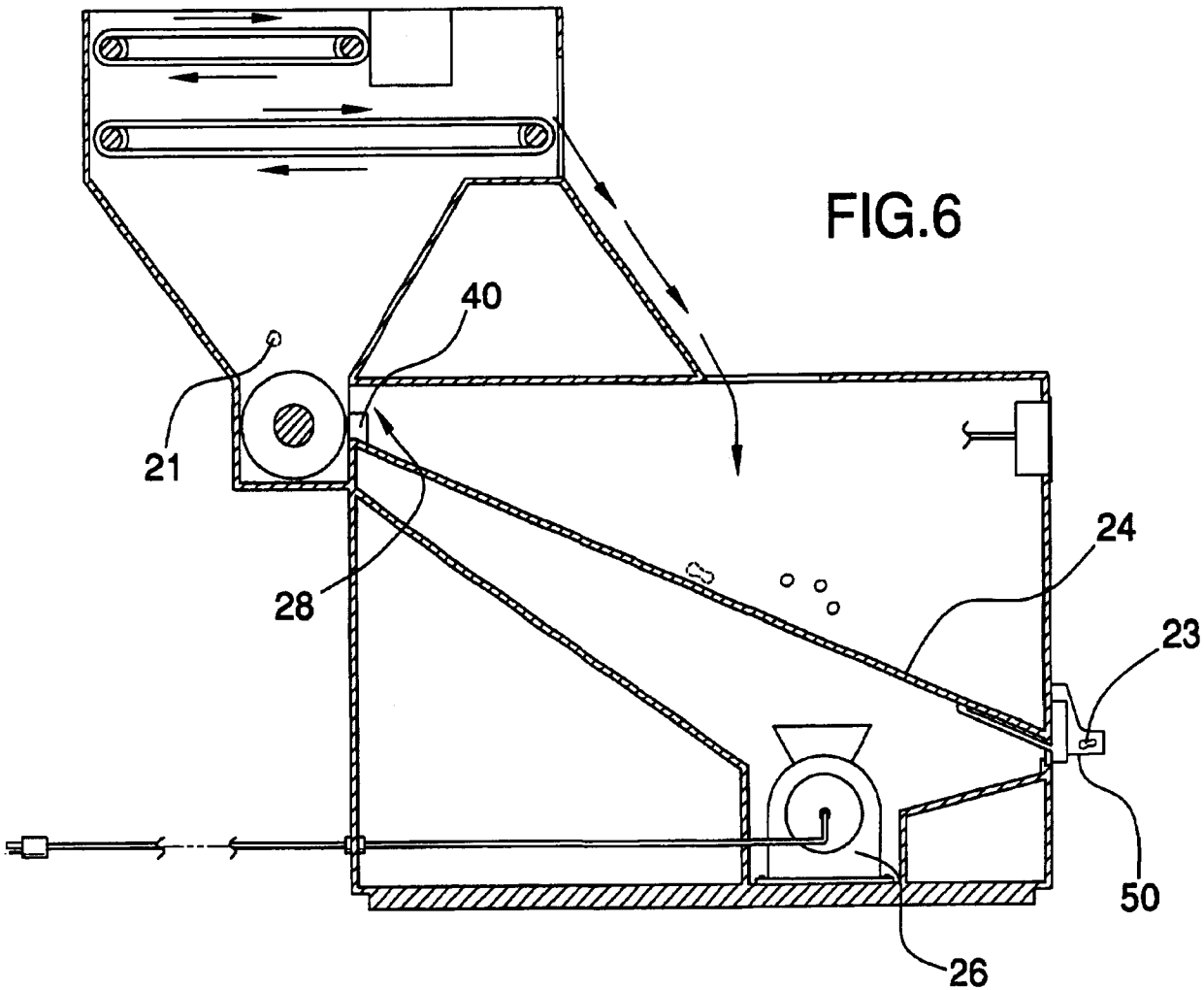
FIG. 6 is a cross-sectional side view of the present invention.
Figure 7:
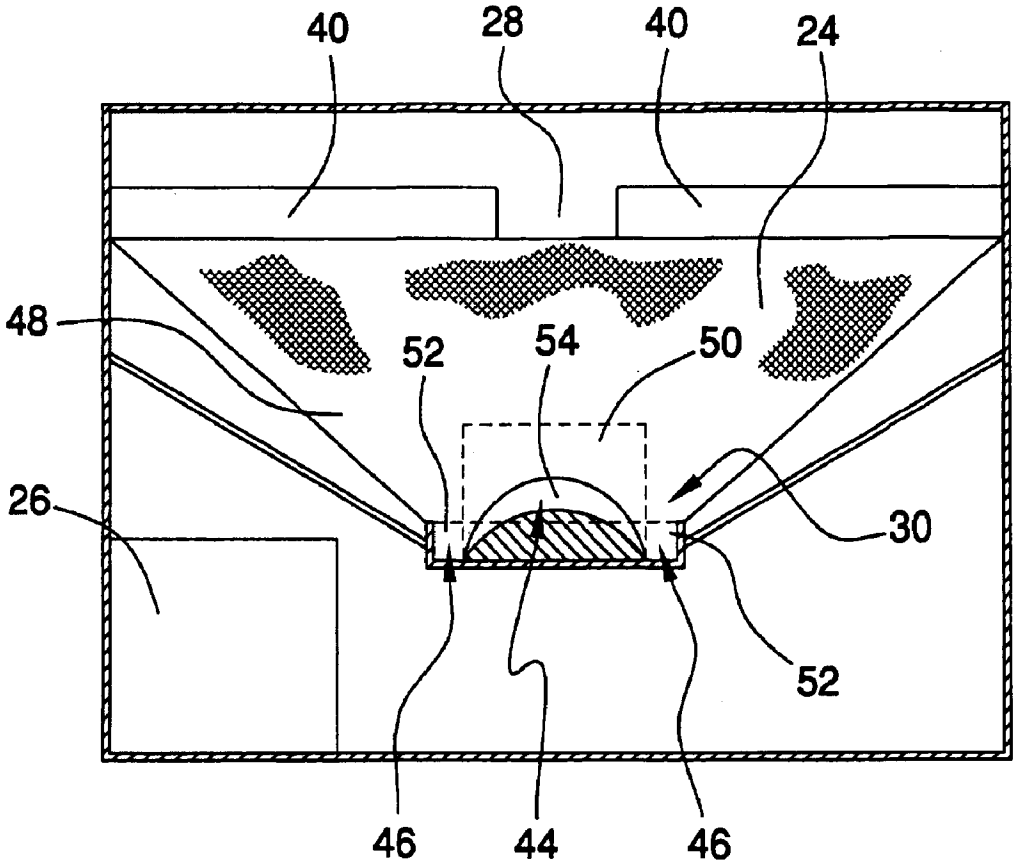
FIG. 7 is a cross-sectional end view of the present invention.

With reference now to the drawings, and in particular to FIGS. 1 through 7 thereof, a new in-shell nut sorting and debris removal assembly embodying the principles and concepts of the present invention and generally designated by the reference numeral 10 will be described.

As best illustrated in FIGS. 1 through 7, the in-shell nut sorting and debris removal assembly 10 generally comprises an initial supply chute 12 for delivering raw materials 14. A first spaced belt sorting assembly 16 is positioned to receive the raw materials 14 from the initial supply chute 12. The first spaced belt sorting assembly. 16 includes a plurality of individual belts spaced apart by a pre-determined distance to permit materials 15 smaller than a first pre-determined size to pass through the first spaced belt sorting assembly 16. A second spaced belt sorting assembly 18 is positioned below the first spaced belt sorting assembly 16. The second spaced belt sorting assembly 18 receives the materials 15 smaller than the first pre-determined size and permits materials 17 smaller than a second pre-determined size to pass through the second spaced belt assembly 18.

A collision chamber assembly 20 includes an input opening 22. The second spaced belt sorting assembly 18 delivers materials 19 larger than the second pre-determined size and smaller than the first pre-determined size into the collision chamber assembly 20 through the input opening 22.

The collision chamber assembly 20 includes an inclined separator mesh screen 24 positioned beneath the input opening 22.

A blower assembly 26 is positioned in the collision chamber assembly 20 and an upward air current through the separator mesh screen 24 such that collisions are promoted between the materials 19 larger than the second pre-determined size and smaller than the first pre-determined size. Thus, relative densities of the materials 19 larger than the second pre-determined size and smaller than the first pre-determined size urge denser materials to a lower end of the separator mesh screen 24 and less dense materials to an upper end of the separator mesh screen 24.

An upper output opening 28 is provided for permitting removal of the less dense materials 21 from the collision chamber assembly 20. A lower output opening 30 is provided for permitting removal of the denser materials 23 from the collision chamber assembly.

An output door 32 selectively covers the lower output opening 30. The door 32 may be electronically controlled to permit adjustment of the door automatically or remotely. The output door 32 is gradually openable to permit selective restriction of distribution of the denser material 23 through the lower output opening 30.

A first belt assembly waste removal means 34 is positioned adjacent to the first spaced belt sorting assembly 16 for receiving materials 13 larger than the first pre-determined size. The first belt assembly waste removal means 34 may be an auger assembly or similar device.

A second belt assembly waste removal means 36 is positioned below the second spaced belt sorting assembly 18 for receiving materials 17 smaller than the second pre-determined size.

An output weir 40 is positioned adjacent to the upper output opening 28.

A collision chamber assembly waste removal means 42 is positioned adjacent the upper output opening 28 for facilitating removal of the less dense materials 21. Similar to the other waste removal means, an auger assembly is suitable but may be provided with another structure for performing the described function.

The lower output opening 30 is divided into an upper portion 44 and a lower portion 46 such that densest materials 25 pass through the lower portion 46.

In an embodiment, the separator mesh screen 26 includes a lower chute portion 48 leading towards the lower output opening 30.

A main chute assembly 50 is coupled to the upper portion 44 of the lower output opening 30 for receiving materials 23 passed through the upper portion 44 of the lower output opening 30.

A waste chute assembly 52 is coupled to the lower portion 46 of the lower output opening 30 for receiving the densest materials 25.

In an embodiment, an insert portion 54 is centrally positioned adjacent to the lower portion 46 of the lower output opening 30 for diverting the densest materials 25 around the insert portion and out opposite sides of the lower portion 46. A pair of waste chute assemblies 58 are then provided, each waste chute assembly 58 being coupled to the lower portion 46 of the lower output opening 30 adjacent to an associated side of the insert portion 54 for receiving the densest materials 25.

In use, raw materials are deposited onto the first spaced belt sorting assembly and the materials having the proper size to pass through the spaced belts of the first spaced belt sorting assembly move onto the second spaced belt sorting assembly. The belts of the second spaced belt sorting assembly are spaced differently than the belts of the first spaced belt sorting assembly to further sort the materials. Unlike the first spaced belt sorting assembly which permits the desirable material to pass through, the second spaced belt sorting assembly retains the desired materials, particularly mature in-shell nuts, and delivers them to the collision chamber assembly. The collision chamber assembly holds the size sorted material and subjects it to collisions created by the introduction of air current upwards through the separator screen mesh. The relative densities of the particles in each collision work to sort the materials with the densest materials moving down to the lower end of the separator screen mesh and the less dense materials moving upwards. Thus, the immature nuts, having less density, are collected and removed from the collision chamber assembly after they pass through the weir, upper output opening and into the collision chamber waste removal means. The desired materials are separated from denser materials such as rocks by division of the lower output opening.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An in-shell nut sorting and debris removal assembly comprising:

an initial supply chute for delivering raw materials;

a first spaced belt sorting assembly positioned to receive said raw materials from said initial supply chute, said first spaced belt permitting materials smaller than a first pre-determined size to pass through said first spaced belt sorting assembly;

a second spaced belt sorting assembly positioned below said first spaced belt sorting assembly, said second spaced belt sorting assembly receiving said materials smaller than said first pre-determined size, said second spaced belt sorting assembly permitting materials smaller than a second pre-determined size to pass through said second spaced belt assembly;

a collision chamber assembly having an input opening, said second spaced belt sorting assembly delivering materials larger than said second pre-determined size and smaller than said first pre-determined size into said collision chamber assembly through said input opening;

said collision chamber assembly having an inclined separator mesh screen positioned beneath said input opening;

a blower assembly positioned in said collision chamber assembly, said blower assembly providing an upward air current through said separator mesh screen such that collisions are promoted between said materials larger than said second pre-determined size and smaller than said first pre-determined size whereby relative densities of said materials larger than said second pre-determined size and smaller than said first pre-determined size urge denser materials to a lower end of said separator mesh screen and less dense materials to an upper end of said separator mesh screen;

an upper output opening for permitting removal of said less dense materials from said collision chamber assembly; and a lower output opening for permitting removal of said denser materials from said collision chamber assembly.

2. The in-shell nut sorting and debris removal assembly of claim 1, further comprising:

an output door selectively covering said lower output opening.

3. The in-shell nut sorting and debris removal assembly of claim 2 further comprising:

said output door being gradually openable to permit selective restriction of distribution of said denser material through said lower output opening.

4. The in-shell nut sorting and debris removal assembly of claim 1, further comprising:

a first belt assembly waste removal means positioned adjacent to said first spaced belt sorting assembly for receiving materials larger than said first pre-determined size.

5. The in-shell nut sorting and debris removal assembly of claim 1, further comprising:

a second belt assembly waste removal means positioned below said second spaced belt sorting assembly for receiving materials smaller than said second pre-determined size.

6. The in-shell nut sorting and debris removal assembly of claim 1, further comprising:

an output weir positioned adjacent to said upper output opening.

7. The in-shell nut sorting and debris removal assembly of claim 6, further comprising:

a collision chamber assembly waste removal means positioned adjacent said upper output opening for facilitating removal of said less dense materials.

8. The in-shell nut sorting and debris removal assembly of claim 1, further comprising:

said lower output opening being divided into an upper portion and a lower portion such that densest materials pass through said lower portion of said lower output opening.

9. The in-shell nut sorting and debris removal assembly of claim 8, further comprising:

a main chute assembly coupled to said upper portion of said lower output opening for receiving materials passed through said upper portion of said lower output opening.

10. The in-shell nut sorting and debris removal assembly of claim 8, further comprising:

a waste chute assembly coupled to said lower portion of said lower output opening for receiving said densest materials.

11. The in-shell nut sorting and debris removal assembly of claim 8, further comprising:

an insert portion centrally positioned adjacent to said lower portion of said lower output opening for diverting said densest materials around said insert portion.

12. The in-shell nut sorting and debris removal assembly of claim 11, further comprising:

a pair of waste chute assemblies, each waste chute assembly being coupled to said lower portion of said lower output opening adjacent to an associated side of said insert portion for receiving said densest materials.

13. The in-shell nut sorting and debris removal assembly of claim 1, further comprising:

said separator mesh screen having a lower chute portion leading towards said lower output opening.

14. An in-shell nut sorting and debris removal assembly comprising:

an initial supply chute for delivering raw materials;

a first spaced belt sorting assembly positioned to receive said raw materials from said initial supply chute, said first spaced belt permitting materials smaller than a first pre-determined size to pass through said first spaced belt sorting assembly;

a second spaced belt sorting assembly positioned below said first spaced belt sorting assembly, said second spaced belt sorting assembly receiving said materials smaller than said first pre-determined size, said second spaced belt sorting assembly permitting materials smaller than a second pre-determined size to pass through said second spaced belt assembly;

a collision chamber assembly having an input opening, said second spaced belt sorting assembly delivering materials larger than said second pre-determined size and smaller than said first pre-determined size into said collision chamber assembly through said input opening;

said collision chamber assembly having an inclined separator mesh screen positioned beneath said input opening;

a blower assembly positioned in said collision chamber assembly, said blower assembly providing an upward air current through said separator mesh screen such that collisions are promoted between said materials larger than said second pre-determined size and smaller than said first pre-determined size whereby relative densities of said materials larger than said second pre-determined size and smaller than said first pre-determined size urge denser materials to a lower end of said separator mesh screen and less dense materials to an upper end of said separator mesh screen;

an upper output opening for permitting removal of said less dense materials from said collision chamber assembly;

a lower output opening for permitting removal of said denser materials from said collision chamber assembly;

an output door selectively covering said lower output opening;

said output door being gradually openable to permit selective restriction of distribution of said denser material through said lower output opening;

a first belt assembly waste removal means positioned adjacent to said first spaced belt sorting assembly for receiving materials larger than said first pre-determined size;

a second belt assembly waste removal means positioned below said second spaced belt sorting assembly for receiving materials smaller than said second pre-determined size;

an output weir positioned adjacent to said upper output opening;

a collision chamber assembly waste removal means positioned adjacent said upper output opening for facilitating removal of said less dense materials;

said lower output opening being divided into an upper portion and a lower portion such that densest materials pass through said lower portion of said lower output opening;

said separator mesh screen having a lower chute portion leading towards said lower output opening; and a main chute assembly coupled to said upper portion of said lower output opening for receiving materials passed through said upper portion of said lower output opening.

15. The in-shell nut sorting and debris removal assembly of claim 14, further comprising:

a waste chute assembly coupled to said lower portion of said lower output opening for receiving said densest materials.

16. The in-shell nut sorting and debris removal assembly of claim 14, further comprising:

an insert portion centrally positioned adjacent to said lower portion of said lower output opening for diverting said densest materials around said insert portion.

17. The in-shell nut sorting and debris removal assembly of claim 16, further comprising:

a pair of waste chute assemblies, each waste chute assembly being coupled to said lower portion of said lower output opening adjacent to an associated side of said insert portion for receiving said densest materials.

* * * * *